United States Patent [19]

Kronman

[11] 4,332,346

[45] Jun. 1, 1982

[54] TWO-WAY ENVELOPE

[75] Inventor: Albert F. Kronman, Locust Valley, N.Y.

[73] Assignee: 21st Century Envelope Co. Inc., Deer Park, N.Y.

[21] Appl. No.: 233,979

[22] Filed: Feb. 12, 1981

[51] Int. Cl.[3] ..... B65D 27/06

[52] U.S. Cl. ..... 229/73

[58] Field of Search ..... 229/73, 92.1, 92.7; 282/25

[56] References Cited

U.S. PATENT DOCUMENTS

| | | | |
|---|---|---|---|
| 2,835,512 | 5/1958 | Whitman | 282/25 |
| 3,084,846 | 4/1963 | Clegg | 229/73 |
| 3,270,948 | 9/1966 | Donovan | 229/73 |
| 3,360,184 | 12/1967 | Greason | 229/73 |
| 3,482,764 | 12/1969 | Aliff, Jr. et al. | 229/72 |
| 4,194,631 | 3/1980 | Rangan | 229/73 |

FOREIGN PATENT DOCUMENTS

| | | | |
|---|---|---|---|
| 9635 | of 1900 | United Kingdom | 229/73 |

*Primary Examiner*—Stephen P. Garbe

*Attorney, Agent, or Firm*—Albert F. Kronman

[57] ABSTRACT

An envelope for two-way mailing having opposed front and rear panels secured together around three sides to provide an open edged pocket, a first flap to seal the pocket is foldably carried on the edge of the pocket by one panel. A sealing flap is carried on the edge of the pocket by the other panel. The resealing flap is inwardly folded upon its panel and disposed within the pocket during the first mailing. A spot of adhesive at each end of the resealing flap between the said flap and its panel, adjacent the open edge portion of said panel, prevents the resealing flap from being severed from the envelope by the improper insertion of a letter opening device.

6 Claims, 5 Drawing Figures

TWO-WAY ENVELOPE

BACKGROUND OF THE INVENTION

Presently known two-way envelopes capable of being made on high speed machinery and at costs which are substantially less than the commonly used enclosed return envelope generally comprise a front panel, a rear panel secured to the front panel to form a pocket, a sealing flap carried by one of the panels to enclose the pocket for the initial mailing and a return sealing flap carried by the other panel to enclose the pocket on its return trip.

If the return sealing flap is severed from its panel in the initial opening of the envelope by the recipient, the two way function is destroyed and the envelope will often be discarded. Severing of the return sealing flap usually occurs from the careless use of letter openers since automatic letter openers merely cut a thin portion from the top of the envelope.

In U.S. Pat. No. 2,317,335 issued Apr. 20, 1943 to Whitman, the return sealing flap is folded upon the rear panel to overlie the outer surface of said panel. The intial sealing flap is drawn over the return flap to cover and protect it during the initial mailing. While explicit instructions for opening the initial sealing flap are set forth in the patent, a letter opener inserted beneath the initial flap could also sever the return flap. U.S. Pat. No. 3,084,846 issued Apr. 9, 1963 to Clegg shows a similar structure in which there is provided a window in one of the panels. Here again, a letter opener blade slipped beneath the initial flap could accidentally engage the return flap and sever it.

U.S. Pat. No. 3,558,040 issued Jan. 26, 1971 to Krueger discloses a return sealing flap tucked into the envelope pocket during the first mailing. The said sealing flap is slipped out of the pocket and used to secure the envelope during the return mailing. Krueger recognizes the danger of accidental severing of the return sealing flap and teaches making the front panel larger than the rear panel to solve the problem. The Krueger envelope may, nevertheless, be subject to the shortcomings of other two-way envelopes upon opening, particularly when the insertions carried by the envelope buckle the return sealing flap within the pocket.

Automatic processing of mail often requires processing information to be carried upon the front of the envelope. Such information may be located close to the bottom edge of the envelope. The return sealing flap is then required to carry the processing information at the same location near the bottom of the envelope. Prior art two-way envelopes limit the length of the return sealing flap and do not lend themselves to automatic processing under the above conditions.

Accordingly, it is an object of the present invention to overcome shortcomings in prior art two-way envelopes.

Another object of the present invention is to provide a two-way envelope in which the return sealing flap is protected from damage during transit and upon opening.

A further object of the present invention is to provide a two-way envelope capable of being manufactured on high speed web-type machines and stuffed on inserting machines.

Still another object of the present invention is to provide a two-way envelope in which the return sealing flap covers substantially all of the front face of the envelope on the return trip.

SUMMARY

A two-way envelope according to the present invention consists of a front panel, a rear panel integral with the front panel, a first sealing flap integral with the front panel and a second or return sealing flap integral with the rear panel. The front and rear panels are substantially equal in width.

The front and rear panels are secured together by means of side flaps to form a pocket. The return sealing flap is folded inwardly upon the rear panel prior to the formation of the pocket so that it is carried within the pocket during the initial mailing. Adhesive means such as glue or wax is disposed at the outer ends of the fold between the rear panel and the return sealing flap. The adhesive seals the outer edges of the said flap and rear panel to prevent damage to the return sealing flap during opening of the envelope. After the envelope is initially opened the return sealing flap is slipped out of the envelope pocket and used to reseal the envelope. The return sealing flap is of a width to substantially cover the entire front panel of the envelope.

BRIEF DESCRIPTION OF THE DRAWING

In the accompanying drawings forming part hereof similar parts have been given identical reference numbers, in which drawings.

DETAILED DESCRIPTION OF THE DRAWING

Figure 1:
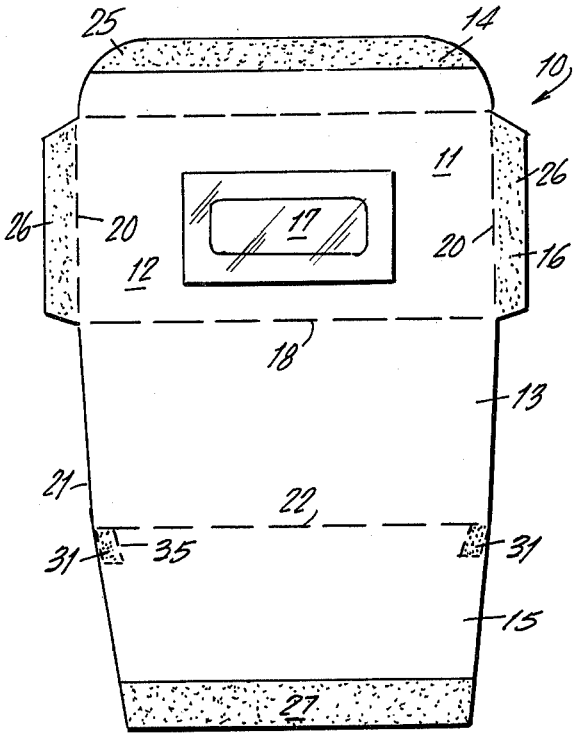
FIG. 1 is a plan view of a blank for a two-way envelope according to the present invention showing the inside surface thereof.

Referring to the drawing and particularly to FIGS. 1–5, there is shown a two-way envelope 10 formed of a single blank of paper 11. The blank 11 contains a rectangular front panel 12 and a rectangular rear panel 13 and first sealing flap 14 integral with the front panel 12 and extending outwardly thereof and a second or return sealing flap 15 integral with the rear panel 13 and extending outwardly thereof. The front panel 12 may contain a window 17 of transparent material such as acetate, glassine or the like, well-known in the envelope art, through which a mailing address 28 may be viewed. The front panel 12 is defined by a bottom fold line 18, a top fold line 19 and side fold lines 20.

The rear panel 13 is defined by the common fold line 18 between the rear and front panel, its side margins 21 and a fold line 22 which lies between the return sealing flap 15 and the rear panel. Side flaps 16 are disposed at each end of the front panel 12 for side sealing purposes.

Figure 4:
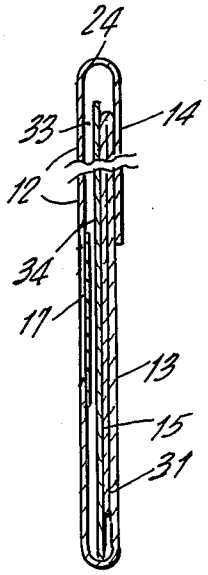
FIG. 4 is a cross sectional view taken on line 4—4 in FIG. 5.
Figure 5:
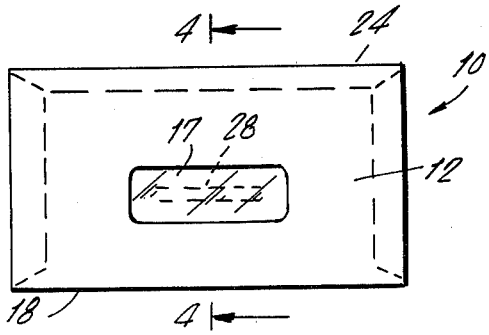
FIG. 5 is a view in front elevation of the two-way envelope, sealed and ready for initial mailing.

The first sealing flap 14 is contiguous with the fold line 19 on the front panel 12. This fold line is so located that it defines the upper edge 24 of the envelope as shown in FIGS. 4 and 5.

A strip of a suitable adhesive is provided at 25 on the first sealing flap 14 for securing the contents to be mailed within the envelope on its initial use. Strips of suitable adhesive material 26 are placed on the side sealing flap 16 as indicated in FIGS. 1 and 3.

Figure 2:
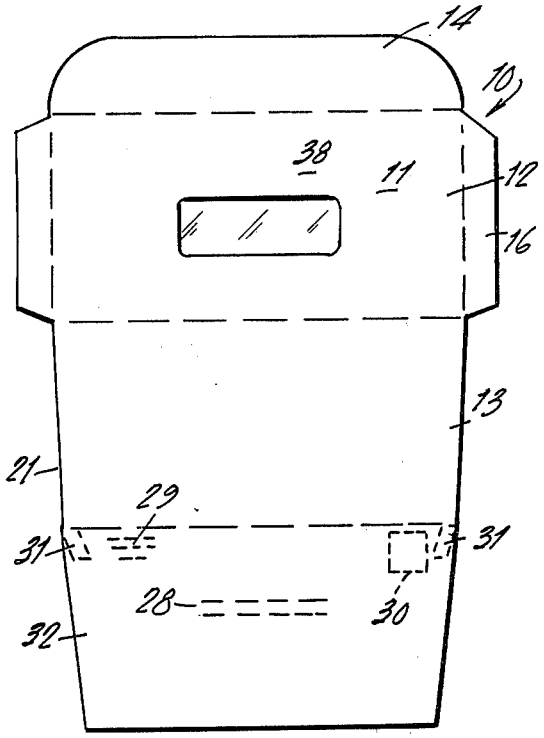
FIG. 2 is a view similar to FIG. 1 showing the outside surface.

FIG. 2 illustrates the front or outer surface of the blank 11 with the fold lines shown in dashed lines. The outer surface of the return sealing flap 15 may be printed with the address of the original sender as indicated by the dashed lines 28. A place for a return address 29 and a stamp 30 may also be indicated on the outer surface of the return flap 15 to aid the person initially receiving the two-way envelope in recognizing the function of the return sealing flap after the envelope has been opened for the first time.

Figure 3:
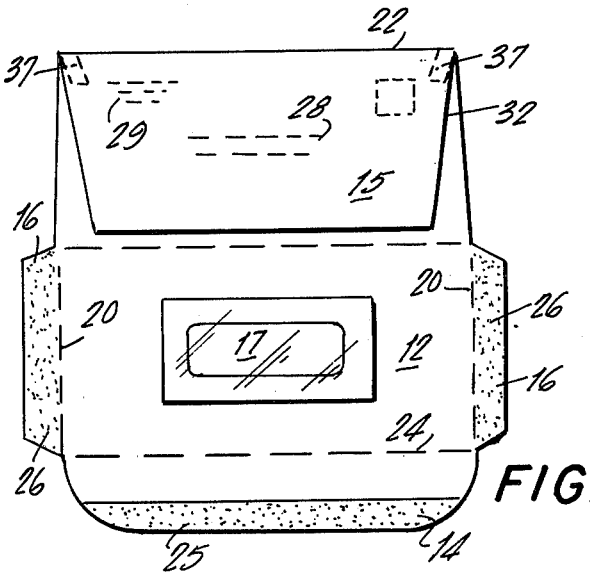
FIG. 3 is a view of the blank of FIG. 1 rotated 180° after the first fold in forming the two-way envelope.

A small spot of adhesive material 31 hereinafter more fully described, best shown in FIG. 1 and indicated in dashed lines in FIGS. 2 and 3, is disposed on the interior of each side of the return sealing flap in the corner formed where the outer adge of said flap meets the fold line 22. When the first step in assembling the two-way envelope is taken as shown in FIG. 3, the adhesive 31 is activated and the return sealing flap 15 is folded inwardly upon fold line 22 thereby placing the said flap upon the inside surface of the rear panel 13. At the same time, the adhesive 31 causes the corner portion of the rear panel and the return sealing flap to become sealed together for a hereinafter more fully described purpose. In the embodiment shown in the drawings the return sealing flap is of a length such that it will substantially equal the length of the front panel 12 when used for the return mailing purpose.

After the return sealing flap is folded into position, the front and rear panels 12, 13 are brought together in overlying position by folding the blank along fold line 18. The adhesive 26 on the side flaps 16 is then activated and the flaps folded upon fold lines 20 and brought around the outer surface of the rear panel 13 to form the pocket 33 of the envelope. An insert 34 such as a letter, bill, advertising material or the like may then be slipped into the pocket 33 of the envelope, as best shown in FIG. 4. The adhesive on the first sealing flap 14 is then activated and the pocket closed in the customary manner. The envelope is then ready for its initial mailing.

Where it is anticipated that automatic openers may be used by the recipient of the envelope, a suitable space such as is shown at the top of FIG. 4 may be provided by a simple adjustment of the fold line 19. This additional space would normally facilitate the insertion of the blade of a hand held letter opener with the possible destruction of the return sealing flap 15. However, the provision of the adhesive material 31 at each corner of the return sealing flap 15 as hereinabove described prevents such accidental destruction of the return sealing flap 15.

The two-way envelope at the end of the first mailing has the appearance shown in FIG. 5. The recipient opens the envelope by cutting along the fold line 22 at the top 24 of the envelope. The insert 34 may then be withdrawn following which the return sealing flap 15 may be slipped out of the pocket 33 of the envelope. With the insert pulled from the pocket, the envelope is ready for its return mailing.

In order to prevent damage to the return sealing flap 15 as it is pulled out of the pocket 33 due to the adhesive 31, it is desired to use an adhesive which will separate as the return sealing flap 15 is fully extended. Any suitable adhesive such as a pressure sensitive adhesive, wax or others well-known in the art may be used for this purpose. It is also within the purview of the present invention to use the same adhesive material at the corners of the return sealing flap 15 as is used on the other areas of the blank for sealing purposes. In this event, the corners of the return sealing flap 15 which bear the adhesive 31 may be perforated around the adhesive as shown at 35 so that as the return sealing flap 15 is fully extended, a small portion of the corners thereof will be torn away without substantially damaging the return sealing flap 15 and without interfering with the sealing integrity of the envelope on its return trip.

It will be noted by an examination of FIGS. 1–4 that the length of the return sealing flap 15 is such that when it is brought over the front surface of the envelope 38 it will substantially cover all of said front surface and cover any printing or other indicia which was placed upon it for the initial mailing.

Having thus fully described the invention, what is claimed and desired to be protected by Letters Patent is:

1. An envelope for two-way mailing formed from a one piece blank having substantially rectangular front and rear panels interconnected along three edges to provide a pocket, and an insert opening for said pocket between the unconnected panel edges of the pocket comprising a first sealing flap carried by and integral with one of said unconnected edges, a second, return sealing flap carried by and integral with the other unconnected edge, said second return sealing flap being folded inwardly along the unconnected panel edge of its supporting panel to extend within the pocket and overlie said supporting panel and a spot of adhesive disposed between a portion of the return sealing flap and its supporting panel adjacent their common fold line at each outer end of said fold line whereby a portion of the return sealing flap is secured to its supporting panel at the outer ends thereof.

2. An envelope according to claim 1 in which the front and back panels are of substantially the same height.

3. An envelope according to claim 1 in which the first sealing flap is carried by the front panel, the second, return sealing flap is carried by the rear panel and the said second sealing flap is of substantially the same height as the front panel.

4. An envelope according to claim 1 in which the second, return sealing flap is perforated to define the area of the spot of adhesive whereby the adhered portion of the second, return sealing flap will be parted from said flap as the second, return sealing flap is readied for the second mailing.

5. An envelope according to claim 1 in which the adhesive is wax.

6. An envelope according to claim 1 in which the adhesive is a pressure sensitive adhesive.

* * * * *